US005158287A

United States Patent [19]

Janes

[11] Patent Number: 5,158,287

[45] Date of Patent: Oct. 27, 1992

[54] TENNIS RACKET HANDLE

[75] Inventor: Richard Janes, Scottsdale, Ariz.

[73] Assignee: Lisco, Inc., Tampa, Fla.

[21] Appl. No.: 676,771

[22] Filed: Mar. 27, 1991

[51] Int. Cl.[5] ..... A63B 49/08

[52] U.S. Cl. ..... 273/73 J; 273/75

[58] Field of Search ..... 273/73 R, 73 J, 75

[56] References Cited

U.S. PATENT DOCUMENTS

| | | | |
|---|---|---|---|
| 3,674,267 | 7/1972 | Hollis | 273/73 J |
| 4,072,312 | 2/1978 | Kahn | 273/75 |
| 4,349,199 | 9/1982 | Vulcano | 273/75 |
| 4,717,152 | 1/1988 | Kessler | 273/75 |
| 4,964,645 | 10/1990 | Lai | 273/73 J |
| 4,978,123 | 12/1990 | Ashihara | 273/73 J X |

FOREIGN PATENT DOCUMENTS

| | | | |
|---|---|---|---|
| 3842126 | 8/1990 | Fed. Rep. of Germany | 273/73 J |
| 229174 | 2/1925 | United Kingdom | 273/73 J |
| 2218641 | 11/1989 | United Kingdom | 273/73 J |
| 8504814 | 11/1985 | World Int. Prop. O. | 273/75 |

*Primary Examiner*—V. Millin
*Assistant Examiner*—William E. Stoll

[57] ABSTRACT

The present application describes a pallet positionable on the handle of a rigid tennis racket frame having a bow end with strings and a handle end opposite therefrom. The pallet is formed with an external cross-sectional configuration having six flat faces and edges extending along a majority of its length. The pallet is fabricated of a dense urethane having a durometer of about between 50 and 80 on a Shore A hardness scale.

4 Claims, 2 Drawing Sheets

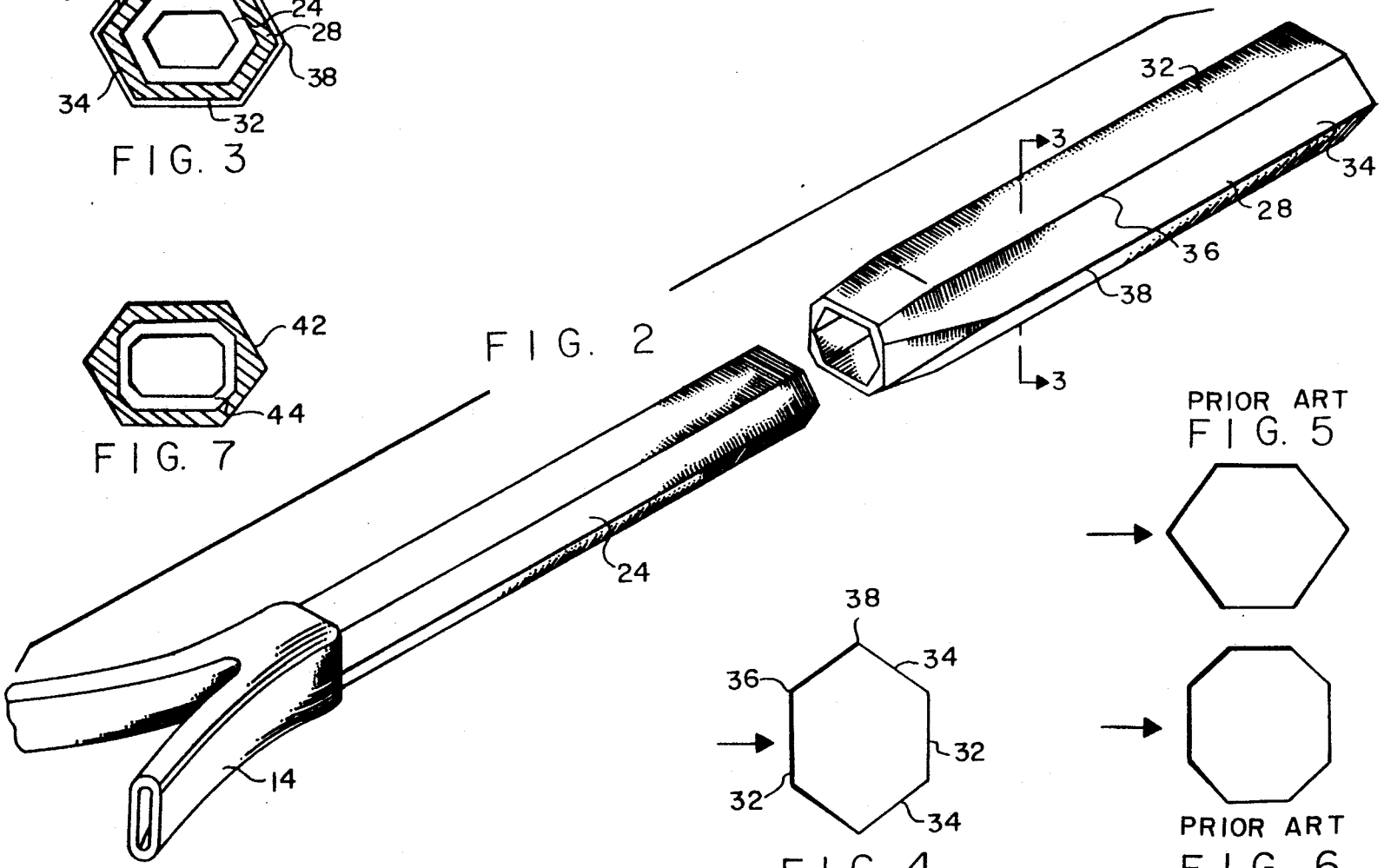
FIG. 2
PRIOR ART
FIG. 5
PRIOR ART
FIG. 6
FIG. 4
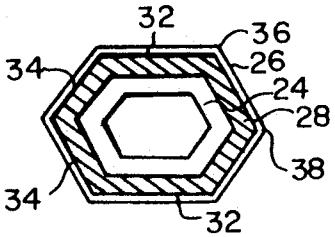
FIG. 3
FIG. 7

TENNIS RACKET HANDLE

BACKGROUND OF THE INVENTION

1. Field of the Invention

This invention relates to tennis rackets with improved handles and, more particularly, to improved tennis racket handles of a six-sided cross-sectional configuration with the major faces parallel with the strings and with a soft pallet between a soft external grip and an rigid internal core.

2. Description of the Background Art

Tennis involves players on opposite sides of a net who employ rackets to strike a resilient ball back and forth over the net. The racket has a first end, the head end, with strings which contact the ball. The tennis racket also has an opposite end, the handle end, which is grasped by the player. The handle is designed for player comfort and is provided with flat faces and edges along its length so that the player may index the string end of the racket and know it rotational orientation without having to observe the position of the strings with respect to the handle.

Handles are conventionally fabricated of a rigid frame which extends forwardly in a loop configuration at the head to support the strings. A supplemental member, the pallet, is provided at the handle end of the frame with a leather or leather like grip material spiral wound around the pallet. Earlier racket employed wood frames with wood pallets which were routed to size and shape. Subsequently, molded pallets provided an advantageous method of easily providing several grip sizes for a common sized frame, especially when metal tube frames and, later, when composite tube frames were developed. Molded pallets are normally formed of a cellular polymeric material which is formed over the handle end of the racket frame. The pallet may also be separately formed and slid in place over the frame ends.

The most common form of pallet has eight faces, symmetrically formed with respect to the plane of the strings. Two faces are parallel with respect to the strings and two faces are perpendicularly formed with respect thereto. The conventional pallet, however, is hard and has been found to inadequately absorb shocks and vibrations to the hand of a player using the racket while striking a ball. Additionally, such conventional hard pallets are fabricated of rigid cellular materials and thus tend to crack and chip.

The background art discloses many types of handles and handle pallets for tennis rackets as well as for other types of hand held devices. To illustrate the wide variety of handle and handle pallets designed for use as tennis rackets, consider pending application Ser. Nos. 07/422,722 and 07/422,723 to Janes. Those applications relate to the use of soft material pallets located between a rigid internal core and a soft external grip. Such pallets, however, are formed with the traditional eight sides.

With respect to six sided rackets, consider U.S. Pat. Nos. 4,349,199 to Vulcano and 4,717,152 to Kessler. According to the Vulcano disclosure, the major faces are not parallel with respect to the strings or each other. With respect to Kessler, the entire pallet and grip taper along with the length of the handle.

Other patents of interest but less pertinent than the two prior art references cited above are U.S. Pat. Nos. 1,452,803; 1,523,638, 2,000,306; 3,086,777; 3,528,658; 3,545,756, 3,625,512; 3,633,910; 3,664,668; 3,899,172; 3,901,507; and 4,278,251. Further, foreign patents of interest include Australian patent 19,911 and German patent 2830198.

The background art discloses a wide variety of handles and handle pallets designed for use in a wide variety of devices to perform a wide variety of functions. They are fabricated of a wide variety of materials, natural and synthetic, and are formed by a wide variety of processes. No background art, however, discloses, teaches or suggests a tennis racket with an improved handle as described herein to provide, in one unit, all of the desirable features. All known handles and handle pallets are simply lacking in one regard or another. As illustrated by the background art, efforts are continuously being made in an attempt to improve handles, including racket handles. No prior effort, however, suggests the present inventive combination of component elements arranged and configured as disclosed herein. Prior handles do not provide the benefits attendant with the present invention.

The present invention achieves its purposes, objects and advantages over the prior art through a new, useful and unobvious combination of component elements, through the use of the minimum number of functioning parts, through the utilization of readily available materials and conventional components all with no increase in cost to manufacture.

Accordingly, it is an object of the present invention to provide an improved pallet positionable on the handle of a rigid tennis racket frame having a bow end with strings and a handle end opposite therefrom, the pallet being formed with an external cross-sectional configuration having six flat faces and edges extending along a majority of its length, the pallet being fabricated of a dense soft urethane having a durometer of about between 50 and 80 on a Shore A hardness scale.

It is a further object of the present invention to absorb shocks and vibrations to the user of a tennis racket during the striking of the ball.

It is a further object of the present invention to increase the mechanical advantage of a tennis racket.

It is a further object of the present invention to increase the ability of users to index a tennis racket during play without having to observe the position of the strings with respect to the handles.

Lastly it is an object of the present invention to construct a tennis racket handle which will increase both indexability and mechanical advantage while minimizing fatigue of the user, with increased indexability being effected by less edges and larger flats, with the larger flats effecting an increased mechanical advantage, and with the softer pallet lessening shock, edge sharpness and fatigue of the user.

The foregoing has outlined some of the more pertinent objects of the invention. These objects should be construed to be more illustrative of some of the more prominent features and applications of the present invention. Many other beneficial results can be attained by applying the disclosed invention in a different manner but by modifying the invention within the scope of the disclosure. Accordingly, other objects and a further understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific preferred embodiment shown in the attached drawings. For the purpose of summarizing the invention, the invention may be incorporated into an improved tennis racket comprising a frame with a bow end with strings and a handle end opposite therefrom, the frame being fabricated from a rigid material, the handle end including a molded pallet on the frame with an external cross-sectional configuration having six flat faces and edges extending along a majority of the length thereof, the pallet being fabricated of a dense soft urethane having a durometer of about between 50 and 80 on a Shore A hardness scale.

Two of the faces are parallel with each other and the strings. The frame beneath the pallet is of the same cross-sectional configuration a the internal cross-sectional configuration of the pallet. The frame beneath the pallet and the internal cross-sectional configuration of the pallet may be six-sided or eight-sided or four-sided parallel ovals.

The invention may also be incorporated into an improved pallet positionable on the handle of a rigid tennis racket frame having a bow end with strings and a handle end opposite therefrom, the pallet being formed with an external cross-sectional configuration having six flat faces and edges extending along a majority of its length, the pallet being fabricated of a dense soft elastomer having a durometer of about between 50 and 80 on a Shore 80 hardness scale.

Two of the faces are major faces, parallel with each other and parallel with the strings. The internal cross-sectional configuration of the pallet may be the same as the external cross-sectional configuration of the pallet or different. The major faces have a common peripheral width. The remaining faces are minor faces, each having a common peripheral width less than that of the major faces. The two angles formed by minor faces are each about 106 degrees. The other four angles are each about 127 degrees. The two major faces each have a peripheral width of about 20.6 millimeters plus or minus 10 percent. The four minor faces peripheral width of about 16.5 millimeters plus or minus 10 percent. The major faces together constitute about 38.4 percent of the circumference of the pallet.

The foregoing is outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other methods and constructions for carrying out the same purposes of the invention. It should also be realized by those skilled in the art that such equivalent instructions do not depart from the spirit and scope of the invention as set forth in the appended claims.

BRIEF DESCRIPTION OF THE DRAWING

For a fuller understanding of the nature and objects of the invention, reference should be had to the following detailed description taken in conjunction with the accompanying drawings in which:

FIG. 2 is an enlarged perspective illustration of the handle of the tennis racket of FIG. 1 with parts exploded and broken away to show certain internal constructions.

FIG. 3 is a cross-sectional view of the handle pallet of the tennis racket taken along line 3—3 of FIG. 2.

FIG. 4 is a cross-sectional view of the pallet of FIGS. 1-3 showing its orientation with regard to ball movement.

FIGS. 5 and 6 are cross-sectional views of prior art pallets also illustrating their orientation wit regard to ball movement.

FIGS. 7, 8 and 9 are cross-sectional views of a pallet and frame ends similar to the FIG. 2 illustration, but illustrating a pallet with cores constructed in accordance with alternate embodiments of the invention.

Similar reference characters refer to similar parts throughout the several figures.

DETAILED DESCRIPTION OF THE INVENTION

Figure 1:
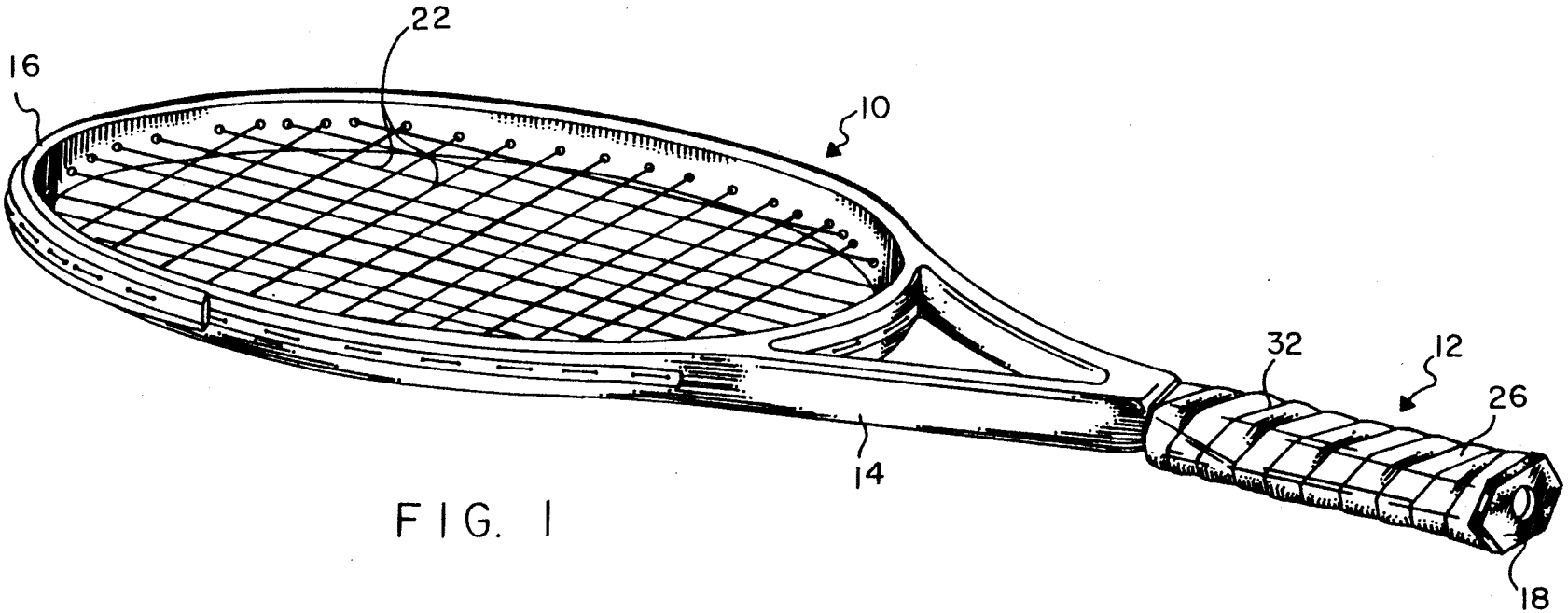
FIG. 1 is a perspective illustration of a tennis racket utilizing the handle of the present invention.

Shown in FIG. 1 is what appears to be an essentially conventional racket 10 but which is provided with the improved handle 12 of the present invention. The tennis racket is fabricated with a frame 14 having a head end 16 and handle end 18. The frame is fabricated of any material including known conventional materials such as aluminum, graphite reinforced epoxy, mixtures of graphite reinforcement fibers in an epoxy matrix.

Adjacent to the head end, the frame is formed as a bow with an opening across which strings 22 are secured under tension to constitute the ball-striking surface. Either side of the strings may constitute the ball-striking surface. Located at the handle end is the handle for being gripped by the use of the racket. At this region, the frame ends extend parallel and either in contact or close proximity with respect to each other.

As is conventional in the art, the handle end includes a rigid interior core 24 formed by the frame ends, a soft external grip 26 and an intermediate pallet 28 which, unlike known rackets, is soft rather than hard. A hardness of 50 to 80 on a Shore A hardness scale is preferred. Preferred elastomeric pallet materials include urethane, silicone rubber, Kraton, etc. Such materials and additional materials are described in my co-pending application, U.S. patent application Ser. No. 07/422,722 filed Oct. 17, 1989, the subject matter of which is incorporated by reference herein.

The handle is provided with a plurality of flat sections or faces 32 and 34 extending longitudinally along the handle. Edges 36 and 38 separate the flat sections and form angles. As shown in the various figures, the handle takes a hexagonal cross-sectional configuration with six flat sections and eight edges. A spiral wound grip as of leather or the like covers the handle pallet for improved gripability.

An additional significant aspect of the present invention includes the use of the six sides in cross section of the pallet, grip and core. The six sides are in symmetric configuration with respect to the racket, frame and plane of the strings. The six sides of the pallet include two similarly shaped larger or major planar faces 32 parallel with each other and parallel to the plane of the strings. Also included are four similarly shaped smaller or minor faces 34. At the lateral edges 36 of the major faces the major faces bend inwardly symmetrically arriving at edges 38 which, along the length of the racket handle, form parallel lines parallel with are parallel with each other and parallel with the center line of the racket and handle.

The handle end terminates in a butt cap. The butt cap is enlarged radially from the handle with a periphery generally matched to the periphery of the handle. The butt cap may have a circular cross-section or a cross-section with sides different from that of the handle. Further, the butt cap may be hard or soft.

The length of the handle is essentially conventional, about 170 millimeters with the major faces parallel with respect to each other along the majority of their lengths and with opposed minor faces parallel with respect to each other. There is an additional 30 millimeters of tapering at the head end of the pallet. Such parallelism effect a non-tapering orientation along the majority of the length of the pallet and handle. From a circumferential standpoint, for a 4½ inch grip the major faces are 20.6 millimeters in peripheral width while each of the remaining four angled minor faces are about 16.5 millimeters. As such, the handle forms in cross-sectional opposed angles of 127 degrees adjacent to the minor faces and 106 degrees at the minor faces. These lengths may be proportionately greater or lesser by about 10 percent when constructing larger or smaller grips. The angles, however, would remain the same.

The particular construction of the present invention provides a greater surface area on the major grip surfaces parallel with the strings. This increases a player's power by having a greater area of hand contact normal to ball movement. This is of advantage whether a player is holding the racket with a Western grip, Eastern grip, Continental grip, etc. In this regard, the faces parallel with the strings in the present invention represent about 38.4 percent of the peripheral width of the pallet in the region to be gripped. This area of the grip parallel with the strings is significantly greater than in prior grips. In prior eight-sided grips for example, a 4½ inch grip has two major flats at 17.4 millimeters, two flats perpendicular thereto at 12.3 millimeters and four flats at angles therebetween at 11.4 millimeters. The flats thus constitute 33.0 percent of the peripheral width. The present invention thus increases the major flats by 16.4 percent for an increased mechanical advantage during use.

As can be seen in the various figures, the faces of the pallet, both internally and externally, form a six sided configuration with all opposed faces parallel with each other and parallel with the six sides of the core of the handle. Indexing is thus derived from the shape of the handle as well as, in part, from the shape of the pallet. The pallet may be molded in the core or separately fabricated and slipped on the core.

It had been thought that such sharp angles at the minor faces would provide excessively sharp edges in the plane of the strings for cutting into the hand of a player over continued use. It has been found through testing, however, that such sharp angles are acceptable when utilized in association with a softer pallet of the present invention. Although the exact reasons are not known for the preference for the newly designed handle construction, it is felt that the reduced number of sides along with the pronounced sharp edge renders the handle orientation more clearly definable than the broader angles of the prior eight sided pallets particularly when used with the soft pallet. In any event, improved results and player preference have been found with the handle of the present invention with its six sided construction and soft pallet.

Figure 9:
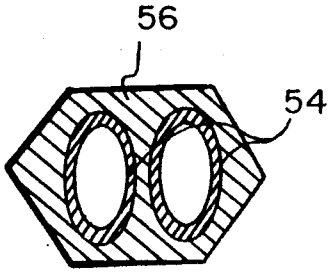
Figure 8:
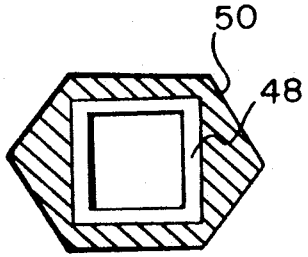

In the above-described embodiment, the interior and exterior surfaces of the pallet 42 are of a similar six sided cross-sectional configuration which is also similar in cross-sectional configuration to the rigid internal core 44 upon which it is positioned. In such embodiment, indexing derives in part from the soft pallet and in part from the rigid core. In the FIG. 7 embodiment, the interior and exterior surfaces of pallet are of a dissimilar cross-sectional configuration but the interior surface of the pallet is of a similar cross-sectional configuration to the rigid internal core upon which it is positioned. Such an arrangement provides a slight deterioration in indexing from the preferred embodiment but is still superior over known rackets and pallets. Other alternate designs are shown in FIGS. 8 and 9. FIG. 8 shows a four-sided cross-sectional core 48 with a conforming pallet 50. FIG. 9 shows a core 54 formed of two ovals with a conforming pallet 56.

Although the present invention has been described in its preferred form with a certain degree of particularity, it is understood that the present disclosure of the preferred form has been made by way of example only and that numerous changes in the details of construction and combination arrangement of parts may be resorted without departing from the spirit and scope of the invention.

Now that the invention has been described, what is claimed:

1. A tennis racket comprising a frame having a bow end with strings in a plane and having a handle end opposite therefrom, the frame being fabricated from a rigid material with two essentially rectangular planar major faces parallel with each other and parallel with the plane of the strings, the handle end including a molded pallet on the frame with an external cross-sectional configuration having six flat rectangular faces and edges extending along a majority of the length thereof, the edges including two edges parallel with each other in the plane of the strings, the pallet being fabricated of a dense soft urethane having a durometer of about between 50 and 80 on a Shore A hardness scale with two essentially rectangular planar major faces parallel with each other and parallel with the major faces of the frame and with four essentially rectangular planar minor faces symmetrically joining the major faces.

2. The racket as set forth in claim 1 wherein the frame has an essentially rectangular cross-section configuration.

3. The racket as set forth in claim 1 wherein the frame has a six-sided cross-sectional configuration.

4. The racket as set forth in claim 1 wherein the faces of the pallet meeting at the plane of the strings to form an angle of about 106 degrees.

* * * * *